US006410834B1

(12) United States Patent
Hearfield

(10) Patent No.: US 6,410,834 B1
(45) Date of Patent: Jun. 25, 2002

(54) PROTECTIVE COVER OF LEATHER FOR A STRINGED MUSICAL INSTRUMENT

(76) Inventor: Barry Neil Hearfield, 19a rue Principale, Sandweiler (LU), L-5240

( * ) Notice: Subject to any disclaimer, the term of this patent is extended or adjusted under 35 U.S.C. 154(b) by 0 days.

(21) Appl. No.: 09/672,869

(22) Filed: Sep. 29, 2000

(30) Foreign Application Priority Data

Oct. 8, 1999 (LU) ..... 90453

(51) Int. Cl.[7] ..... G10G 5/00
(52) U.S. Cl. ..... 84/453; 84/267
(58) Field of Search ..... 84/267, 453, 290; 206/314, 14; 260/314, 14

(56) References Cited

U.S. PATENT DOCUMENTS 4,190,152 A * 2/1980 Reiter ..... 206/314
4,601,391 A * 7/1986 Gibbs et al. ..... 206/314
4,846,340 A * 7/1989 Walther ..... 206/14
D322,717 S * 12/1991 Wyant ..... 84/453
5,590,771 A * 1/1997 Cota ..... 206/314
5,725,094 A * 3/1998 Moral ..... 206/314
5,783,762 A * 7/1998 Lindauer ..... 84/282
6,054,642 A * 4/2000 Brooks ..... 84/267

* cited by examiner

*Primary Examiner*—Robert E. Nappi
*Assistant Examiner*—Kim Lockett

(57) ABSTRACT

A protective cover, comprising one or more specially cut and perforated pieces of leather and a means whereby said protective cover can be attached tightly to the body of a stringed musical instrument, such as a solid-bodied electric guitar, which affords substantial protection to the body and any eventual finish on the body of said instrument against such scratches, cracks, dents, wear and other damage as can occur during normal usage, handling and transportation of said instrument, such protection being more comprehensive than known existing protective covers for such instruments by virtue of the proposed cover enclosing the entire visible surface of the body of said instrument and which, furthermore, affords desirable visual and tactile aesthetic qualities said stringed musical instrument.

6 Claims, 2 Drawing Sheets

PROTECTIVE COVER OF LEATHER FOR A STRINGED MUSICAL INSTRUMENT

CROSS-REFERENCE TO RELATED APPLICATIONS

Prior application for a national patent covering the same invention as claimed in this application was filed in the Grand Duchy of Luxembourg on Oct. 8, 1999, under the filing number LU 90453, with the title 'Protective cover of leather for stringed musical instrument', by HEARFIELD Barry Neil, residing at 19a rue Principale, L-5240 Sandweiler, Luxembourg. Said national patent is currently pending.

Although the present application has been modified to more accurate the instructions set out in the USPTO's Guide to Filing a Utility Patent Application, the substance of the invention as claimed in the aforementioned national pates application remains unchanged.

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

The invention disclosed in this patent application relates to the field of protective covers for stringed musical instruments.

Such protective covers are to be considered of utility as the bodies of stringed musical instruments, during normal usage, handling and transportation of such instruments, are susceptible to scratches, cracks, dents, wear and other damage. Such damage can reduce the useful lifetime of the instruments, reduce, in some cases, their playability and adversely affect their aesthetic qualities.

Some stringed musical instrument bodies, the majority of which are made from wood, are left natural; that is to say they are not provided with any protective finish, leaving the surface of said bodies totally unprotected against the kinds of damage as previously described.

To afford some protection against such damage, manufacturers of stringed musical instruments generally apply a coating of paint, varnish or a similar finish the bodies of such instruments.

Although a coating of paint, varnish or similar finish when applied to the body of a stringed musical instrument affords some protection against such damage as previously described, such coating is itself susceptible to the same kinds of damage, hereby affording only limited protection to said body overall.

Various means of affording further protection for stringed musical instrument bodies have been devised, including those inventions that are claimed in the following U.S. patent documents:

U.S. Pat. No. 6,054,642
April, 2000 Brooks
U.S. Pat. No. 5,725,094 March, 1998 Moral
U.S. Pat. No. 5,218,149 June, 1993 Tanaka et al.
U.S. Pat. No. 4,601,391 July, 1986 Gibbs et al.
U.S. Pat. No. 4,177,847 December, 1979 Spindler
U.S. Pat. No. 4,000,678 January, 1977 Messina Such known means of affording further protection for stringed musical instrument bodies against such damage as previously described are of limited effectiveness or viability in that they either

- leave parts of said bodies exposed, thus not affording complete protection, or
- reduce the playability of said instruments, or
- adversely affect the quality of the sounds produced by said instruments, or
- compromise the protection claimed by incorporating metal or other hard components such as zippers, which can themselves cause damage to said instrument tees when not adequately separated therefrom, or
- require substantial adaptation of the stringed musical instruments themselves at the stage of manufacture of said instruments, thus entailing high costs, or
- could be construed as aesthetically undesirable by the musicians for whom said means are intended.

As a result, the vast majority of stringed musical instruments that are currently available at retail level have either no means whatsoever, only limited means, or inadequate means of affording protection to the bodies of said instruments against such damage as previously described.

BRIEF SUMMARY OF THE INVENTION

The object of the present invention is to provide a protective cover for a stringed musical instrument, said cover having the following desirable qualities:

- affords substantial protection to the entire surface of the body of said instrument against such scratches, cracks, dents, wear and other damage as can occur during normal usage, handling and transportation of such an instrument
- does not substantially affect the playability of such an instrument
- does not substantially affect the quality of the sounds produced by such an instrument
- does not incorporate metal or other hard components in such a way the said components can damage the body of such an instrument
- does not require any adaptation to said instrument itself at the stage of manufacture of such an instrument
- is lightweight and durable
- has desirable visual and tactile aesthetic characteristics.

The aforementioned object is attained by the invention as claimed in this patent application by virtue of said invention being a protective cover manufactured by hand and/or machine to fit snugly onto the body of a stringed musical instrument in such a way as to completely enclose the visible surface of said body, thereby affording comprehensive protection against such damage as previously described. Said invention comprises one or more specially cut and perforated pieces of leather and a means whereby the protective cover thus formed by said piece(s) of leather can be attached tightly to the body of a stringed musical instrument, as more filly explained in the Detailed description of the invention.

DETAILED DESCRIPTION OF THE INVENTION

Figure 1:
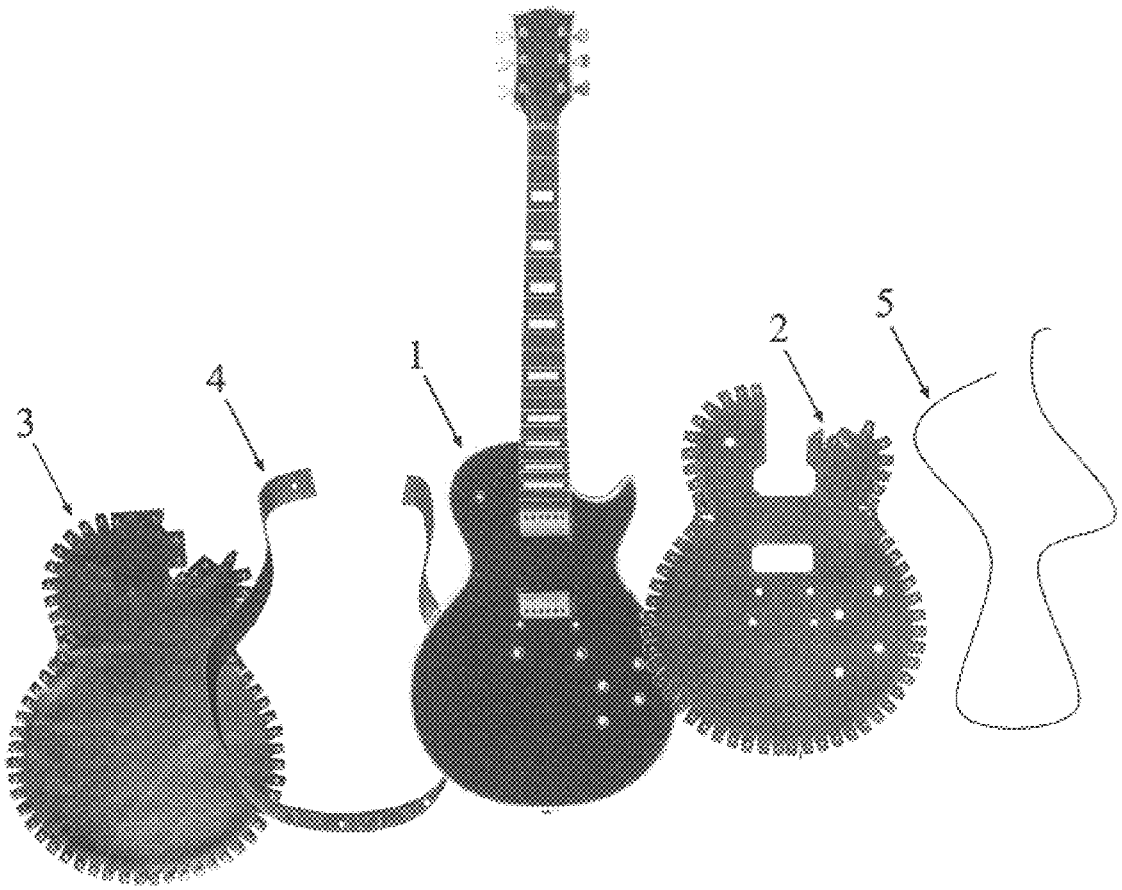
FIG. 1 illustrates the disassembled components of one possible embodiment of the protective cover of leather and a stringed musical instrument for which said cover is intended; in this case a solid-bodied electric guitar.

The invention claimed in this patent application is a protective cover designed to be attached firmly and snugly to the body of a stringed musical instrument in such a way as to afford substantial and comprehensive protection to said body against such scratches, cracks, dents, wear and other damage as can occur during normal usage, handling and transportation of such an instrument.

The invention can essentially be considered as comprising two components: the cover itself and a means whereby said cover can be attached tightly to the body of the stringed musical instrument.

The first component consists of one or more pieces of leather, specially cut and perforated so as to form a cover that completely encloses the visible surface of the body of the instrument, thus providing more comprehensive protection than some existing protective covers that leave parts of the instrument body exposed.

The second component consists of any of various means of protective cover to the body of a stringed musical instrument in such a way that is held tightly in place and fits said body snugly so as not to adversely affect the playability or normal functioning of said instrument. Five such means are herein proposed, as further described in the section dealing with possible embodiments.

Leather has been chosen as the ideal material from which to manufacture the proposed protective cover as it is tough and durable. It therefore provides more substantial protection against the kinds of damage as previously described than some existing occurs that utilize thin plastics, cotton or other textile materials. Leather is also readily workable by hand and/or machine, and is therefore suitable for adaptation to the complex shape of a stringed musical instrument body. Furthermore, it has inherent visual and tactile properties that are aesthetically desirable for this invention. Because leather exists in a wide variety of types, colours, thickness and degrees of softness, a large range of protective covers in accordance with this invention can be manufactured with a great diversity of aesthetic characteristics, thereby affording the end-user a choice of cover that specifically matches his or her musical instrument according to his or her aesthetic preferences. The proposed cover can be further customized by using various techniques known to leathercrafters, such as carving, embossing, branding, lacing or stitching, to add decorative designs or lettering. Such aesthetic diversity is a further advantage of the proposed protective cover over some existing ones that are less customizable.

Note: although the protective cover of leather proposed herein will itself be susceptible to scratches and other wear over time, this will be considered aesthetically desirable by some end-users in a similar way to a faded pair of jeans or other item of clothing being considered a favoured possession by some people.

Five possible embodiments of a protective cover of leather in accordance with the present invention will now be proposed, wherein each embodiment uses a different means for tightly attaching said cover to the body of a stringed musical instrument. All the embodiments have the following characteristics in common:

- the covers are of leather (Note: a type of leather should be selected whose thickness does not adversely affect the playability or the normal functioning of the musical instrument)
- the covers are perforated in the relevant places so as to allow the body hardware of the stringed musical instrument (such as pick-ups, pick-up combination switch, volume and tone control knobs, bridge, tailpiece, carrier-strap fastenings, output jack, etc.) to protrude and to function normally once said hardware has been reassembled on the body of said instrument with the protective cover attached
- the covers are designed in such a way that they have the desirable qualities as previously detailed in the section Brief summary of the invention.

Possible Embodiment 1, with Relevance to FIG. 1, Comprises

- a 'front piece' of leather (2), which is cut so that when placed flat on the front surface of the body of a stringed musical instrument (1) (in this example a solid-bodied electric guitar), with the necessary body hardware of said stringed musical instrument removed, it overlaps said front surface equally around the perimeter by approximately half the thickness of the body of said stringed musical instrument, is perforated in the relevant places so that said body hardware can later be reattached, and has eyelet-reinforced perforations set around its circumference at approximately two centimeters apart and one centimeter in from its outer edge
- a 'back piece' of leather (3), which is cut so that when placed flat on the back surface of the body of the stringed musical instrument (1) it overlaps said back surface equally around the perimeter by approximately half the thickness of the body said stringed musical instrument and has eyelet-reinforced perforations set around circumference at approximately two centimeters apart and one centimeter in from its outer edge
- a 'side piece' of leather (4), which is of a width approximately equal to the thickness of the body of the stringed musical instrument (1) and of a length approximately equal to the circumference of the body of said stringed musical instrument
- a length of leather lace (5).

Assembly Method for Possible Embodiment 1

The strings and necessary body hardware are removed from the stringed musical instrument (1). The body of said stringed musical instrument is positioned, with its back surface facing down, on top of the back piece of leather (3). The front piece of leather (2) is positioned on the front surface of the body of said stringed musical instrument. The side piece of leather (4) is fitted around the side of the body of said stringed musical instrument. The outer edges of the front piece of leather (2) and the back piece of leather (3) are folded over the side of the body of said stringed musical instrument and laced tightly together by means of passing the length of leather lace (5) in an alternating fashion through the eyelet-reinforced perforations set into said front and back pieces of leather, thus enclosing the body of said stringed musical instrument and said side piece of leather, said side piece of leather thus preventing said eyelets from damaging the side surface of the body of said stringed musical instrument. The two ends of said length of leather lace a secured by knotting them or by other means. The body hardware and strings are reattached to said stringed musical instrument.

Figure 2:
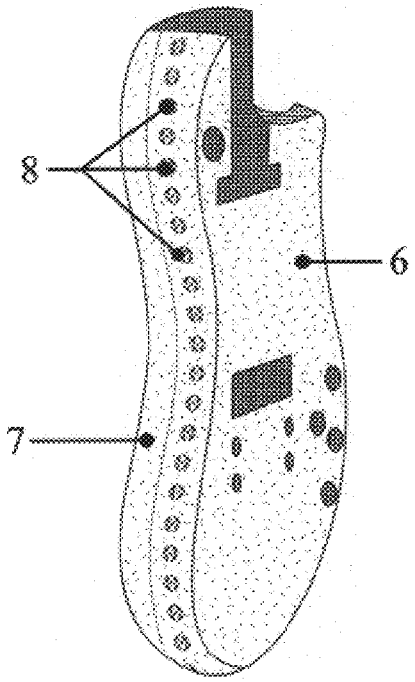
FIGS. 2, 3 and 4 illustrate second, third and fourth possible embodiments, respectively, in which each embodiment uses a different means whereby the protective cover of leather can be tightly attached to a stringed musical instrument.

Possible Embodiment 2, with Relevance to FIG. 2, Comprises

- a 'front piece' of leather (6), which is cut so that when placed flat on the front surface of the body of a stringed musical instrument, with the necessary body hardware of said stringed musical instrument removed, it overlaps said front surface equally around the perimeter by approximately two thirds the thickness of the body of said stringed musical instrument, is perforated in the relevant places so that said body hardware can later be reattached, and has press-stud halves (8) set around its circumference at approximately two centimeters apart and one centimeter in from its outer edge a 'back piece' of leather (7), which is cut so that when placed flat on the back surface of the body of a stringed musical instrument it overlaps said back surface equally around the perimeter by approximately two thirds the thickness of the body of said stringed musical instrument and has corresponding press-stud halves set around its circumference at approximately two centimeters apart and one centimeter in from its outer edge a 'side piece' of leather (not visible in the illustration), which is of a width approximately equal to the thickness of the body of the stringed musical instrument and of a length approximately equal to the circumference of the body of said stringed musical instrument.

Assembly Method for Possible Embodiment 2

The strings and necessary body hardware are removed from the stringed musical instrument. The body of said stringed musical instrument is positioned, with its back surface facing down, on top of the back piece of leather (7). The front piece of leather (6) is positioned on the front surface of the body of said stringed musical instrument. The side piece of leather is fitted around the side of the body of said stringed musical instrument. The outer edges of the front piece of leather (6) and the back piece of leather (7) are folded over the side of the body of said stringed musical instrument and fastened tightly together by means of pressing together the press-stud halves (8) set into said front piece of leather and the corresponding press-stud halves set into said back piece of leather, thus enclosing the body of said stringed musical instrument and said side piece of leather, said side piece of leather thus preventing said press-stud halves from damaging the side surface of the body of said stringed musical instrument. The body hardware and strings are reattached to said stringed musical instrument.

Figure 3:
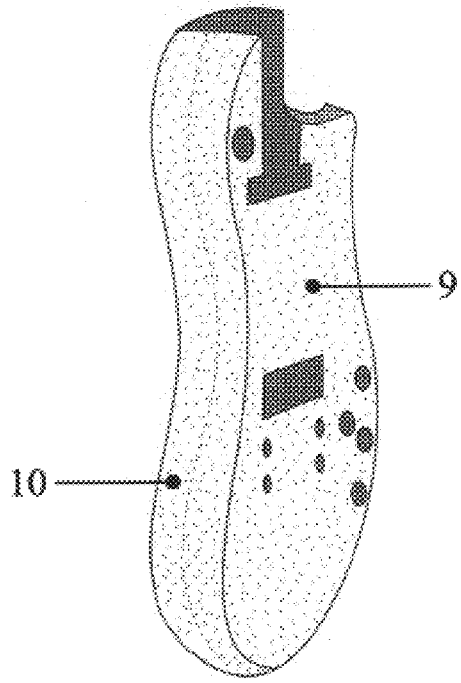

Possible Embodiment 3, with Relevance to FIG. 3, Comprises a 'front piece' of leather (9), which is cut so that when placed flat on the front surface of the body of a stringed musical instrument, with the necessary body hardware of said stringed musical instrument removed, it overlaps said front surface equally around the perimeter by approximately two thirds the thickness of the body of said stringed musical instrument, is perforated in the relevant places so that said body hardware can later be reattached, and has a strip of burred nylon fabric, such as Velcro™, sewn around the circumference of said front piece approximately five millimeters in from its outer edge on the side that will be closest to the body of said stringed musical instrument a 'back piece' of leather (10), which is cut so that when placed flat on the back surface of the body of a stringed musical instrument it overlaps said back surface equally around the perimeter by approximately two thirds the thickness of the body of said stringed musical instrument and has a strip of looped nylon fabric, such as Velcro™, sewn around the circumference of said back piece at an appropriate distance in from its outer edge on the side that will be furthest from the body of said stringed musical instrument.

Assembly Method for Possible Embodiment 3

The strings and necessary body hardware are removed from the stringed musical instrument. The body of said stringed musical instrument is positioned with its back surface facing down, on top of the back piece of leather (10). The front piece of leather (9) is positioned on the front surface of the body of said stringed musical instrument. The outer edges of the front piece of leather (9) and the back piece of leather (10) are over the side of the body of said stringed musical instrument and fastened tightly together by means of pressing together the strips of burred and looped nylon fabric sewn into said front and back pieces of leather, thus enclosing the body of said stringed musical instrument. The body hardware and strings are reattached to said stringed musical instrument.

Figure 4:
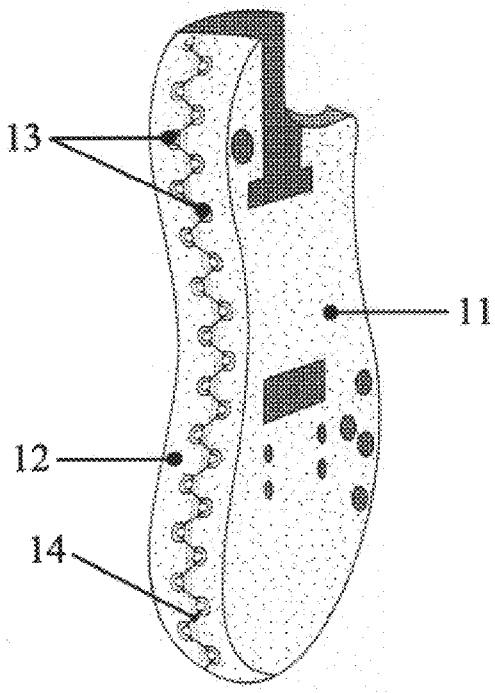

Possible Embodiment 4, with Relevance to FIG. 4, Comprises a 'front piece' of leather (11), which is cut so that when placed flat on the front surface of the body of a stringed musical instrument, with the necessary body hardware of said stringed musical instrument removed, it overlaps said front surface equally around the perimeter by approximately half the thickness of the body of said stringed musical instrument, is perforated in the relevant places so that said body hardware can later be reattached, and has ice-skate-type hooks (13) set around its circumference at approximately two centimeters apart and one centimeter in from its our edge on the side that will be furthest from the body of said stringed musical instrument a 'back piece' of leather (12), which is cut so that when placed flat on the back surface of the body of a stringed musical instrument it overlaps said back surface equally around the perimeter by approximately half the thickness of the body of said stringed musical instrument and has ice-skate-type hooks (13) set around its circumference at approximately two centimeters apart and one centimeter in from its outer edge on the side that will be furthest from the body of said stringed musical instrument a 'side piece' of leather (not visible in the illustration), which is of a width approximately equal to the thickness of the body of the stringed musical instrument and of a length approximately equal to the circumference of the body of said stringed musical instrument a length of leather lace (14).

Assembly Method for Possible Embodiment 4

The strings and necessary body hardware are removed from the stringed musical instrument. The body of said stringed musical instrument is positioned, with its back surface facing down, on top of the back piece of leather (12). The front piece of leather (11) is positioned on the front surface of the body of said stringed musical instrument. The side piece of leather is fitted around the side of the body of said stringed musical instrument. The outer edges of the front piece of leather (11) and the back piece of leather (12) are folded over the side of the body of said stringed musical instrument and laced together by means of tightly passing the length of leather lace (14) in an alternating fashion around the ice-skate-type hooks (13) set into said front and back pieces of leather, thus enclosing the body of said stringed musical instrument and said side piece of leather, said side piece of leather thus preventing said ice-skate-type hooks from damaging the side surface of the body of said stringed musical instrument. The two ends of said length of leather lace are secured by knotting them or by other means. The body hardware and strings are reattached to said stringed musical instrument.

Possible embodiment 5, for which no illustration is necessary, comprises one or more specially cut and perforated pieces of leather that form a protective cover in accordance with the present invention, such as, but not restricted to, one made using any of such methods as used in possible embodiments 1, 2, 3 or 4 a strong adhesive.

Assembly Method for Possible Embodiment 5

One or more pieces of leather are specially cut and perforated in the relevant places so as to form a cover that snugly fits the shape of a stringed musical instrument's body, enclosing the entire visible surface of said body while not adversely affecting the playability or normal functioning of said stringed musical instrument. The stings and necessary body hardware are removed from the stringed musical instrument. A strong adhesive is applied to the surface of the body of said stringed musical instrument and/or to the inside of the leather cover. Said leather cover is positioned upon said body. The body hardware and strings are reattached to said stringed musical instrument.

Note: the methods for making protective covers as described in possible embodiments 1, 2, 3 and 4 afford the end-user the advantage of being able to remove the cover from the instrument at any time. He/she may choose to do so when, for example, he/she wants a different 'look' for his/her instrument on a particular occasion, or when he/she decides to replace an ageing cover with a newer one. Possible embodiment 5, however, describes a method in which the protective cover is permanently attached to the instrument. This method offers distinct advantages to the manufacturers of such instruments as less care needs to be taken in selecting the type of wood used for the instrument's body (tonal qualities cannot be ignored, obviously, but wood that would otherwise rejected for having minor aesthetic imperfections can now be used), it obviates the for applying paint, varnish or other coating to the body, and reduces the overall costs incurred by manufacturing the instrument and the cover as separate products. Furthermore, this method does not exclude the incorporation of design components proposed, such as the leather lacing techniques used in possible embodiments 1 and 4, which could be retained for aesthetic if not functional purposes.

It should be noted that the possible embodiments described herein do not constitute a definitive or exhaustive list of methods that could be used to manufacture a protective cover of leather for a stringed musical instrument in accordance with the present invention. They serve to provide an understanding of the general inventive concept involved.

What I claim as my invention is:

1. A protective cover, which, when attached to the body of a stringed musical instrument, such as an electric guitar, encloses at least 95% of the visible surface of said body of a stringed musical instrument, said protective cover comprising one or more pieces of leather cut, perforated and joined along the edges by a fastening means set therein to enable said piece(s) of leather to be fitted snugly to the front, back and side surfaces of said body of a stringed musical instrument.

2. A protective cover as recited in claim 1 wherein the fastening means is threaded.

3. A protective cover as recited in claim 1 wherein the fastening means is press studs.

4. A protective cover as recited in claim 1 wherein the fastening means is a zipper.

5. A protective cover as recited in claim 1 wherein the fastening means is interlocking looped and burred fabric strips.

6. A protective cover as recited in claim 1 wherein the fastening means is an adhesive.

* * * * *